US006453486B1

(12) United States Patent
Chen

(10) Patent No.: US 6,453,486 B1
(45) Date of Patent: Sep. 24, 2002

(54) DETACHABLE BRACKET FOR SHOWER HEAD

(75) Inventor: Wen-Hsiang Chen, Taipei (TW)

(73) Assignee: Moon Signal MFGS Association, Taipei (TW)

( * ) Notice: Subject to any disclaimer, the term of this patent is extended or adjusted under 35 U.S.C. 154(b) by 0 days.

(21) Appl. No.: 09/879,990

(22) Filed: Jun. 14, 2001

(51) Int. Cl.[7] ..... A47K 3/28
(52) U.S. Cl. ..... 4/605; 239/283; 248/218.4
(58) Field of Search ..... 4/605, 615, 567, 4/597; 248/218.4, 219.4, 75, 295.11; 239/283, 588

(56) References Cited

U.S. PATENT DOCUMENTS 4,964,573 A * 10/1990 Lipski ..... 239/283
5,481,765 A * 1/1996 Wang ..... 4/605
5,749,552 A * 5/1998 Fan ..... 4/605 X

FOREIGN PATENT DOCUMENTS

| | | | |
|---|---|---|---|
| FR | 2377184 | * 11/1978 | |
| GB | 2211728 | * 12/1989 | ..... 4/610 |
| JP | 10-25778 | * 1/1998 | |

* cited by examiner

*Primary Examiner*—Ramon O. Ramirez
(74) *Attorney, Agent, or Firm*—Bacon & Thomas, PLLC

(57) ABSTRACT

A detachable bracket. The bracket includes a body having an elongate slot open to the internal end and the surface, an engagement member inserted into the slot, the engagement member having a concave surface facing the slot, a threaded member releasably secured onto the slot, and a pivot member at the outer end of the body. The pivot member includes a longitudinal groove perpendicular to the slot. In assembly, mount a sliding post to body from the internal end of the slot, insert the engagement member into the slot to engage the concave surface with the post, secure the threaded member onto the slot, and hand a shower head on the groove.

7 Claims, 3 Drawing Sheets

DETACHABLE BRACKET FOR SHOWER HEAD

FIELD OF THE INVENTION

The present invention relates to shower head and more particularly to a detachable bracket for shower head with improved characteristics.

BACKGROUND OF THE INVENTION

A conventional bracket for shower head is usually fixed to a predetermined position. The bracket is configured to have a shower head support. Bracket is usually threadedly secured to the wall of bathroom. It is disadvantageous because the height of bracket is not adjustable. This means that user has to adjust the shower head manually or take another position in order to obtain a better showering angle. This is not convenient for bathing. Moreover, it is understood that some persons are tall while some are short. This design really does not relax people at all while taking a shower.

Another conventional bracket for shower head is made height adjustable. In detail, a longitudinal through hole is provided on the bracket. A post is passed through and slidable on the hole. But this is still unsatisfactory for the purpose for which the invention is concerned for the following reasons. Bracket and post are formed integrally and sold as a whole. User is only required to fix bracket on the wall prior to using it. The drawback is that it is required to detach bracket from the wall and replace with a new set of bracket and post once bracket and/or post is malfunctioned. This is not economical. Further, the wall may be damaged during detaching the bracket. Thus improvement exists.

SUMMARY OF THE INVENTION

It is an object of the present invention to provide a detachable bracket for shower head for eliminating the disadvantage of prior art which requires user to adjust the shower head manually or take another position in order to obtain a better showering angle due to the nonadjustable height of bracket. The detachable bracket for shower head of the invention can enable people to enjoy bathing.

In one aspect of the present invention, the detachable bracket for shower head can eliminate the disadvantage of prior art which requires user to detach bracket from the wall and replace with a new set of bracket and post once bracket and/or post is malfunctioned. The detachable bracket for shower head of the invention can save cost, protect wall of bathroom, and effect an environmental design.

The above and other objects, features and advantages of the present invention will become apparent from the following detailed description taken with the accompanying drawings.

DETAILED DESCRIPTION OF THE PREFERRED EMBODIMENTS

Figure 1:
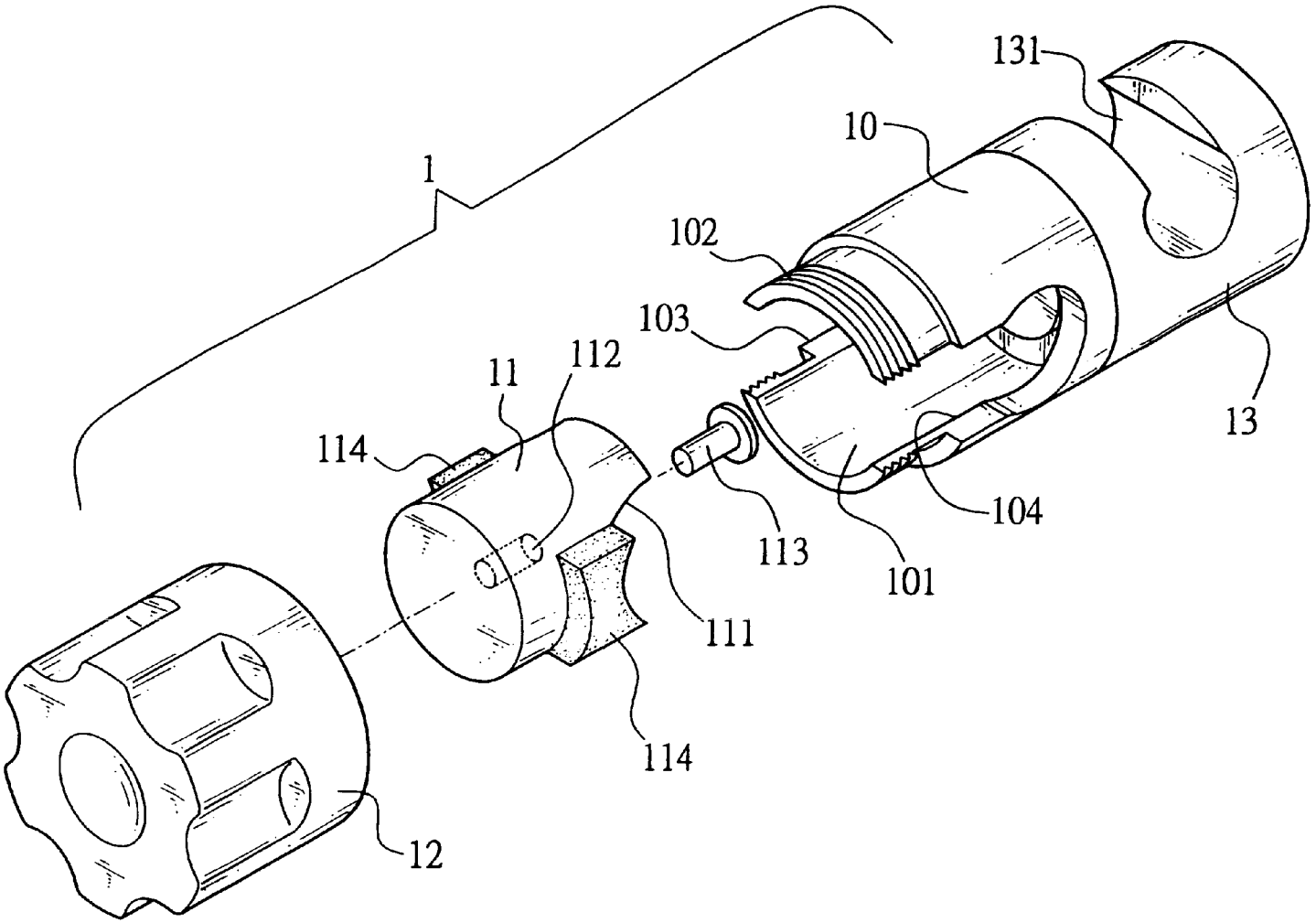
FIG. 1 is an exploded view of a detachable bracket for shower head according to the invention.
Figure 2:
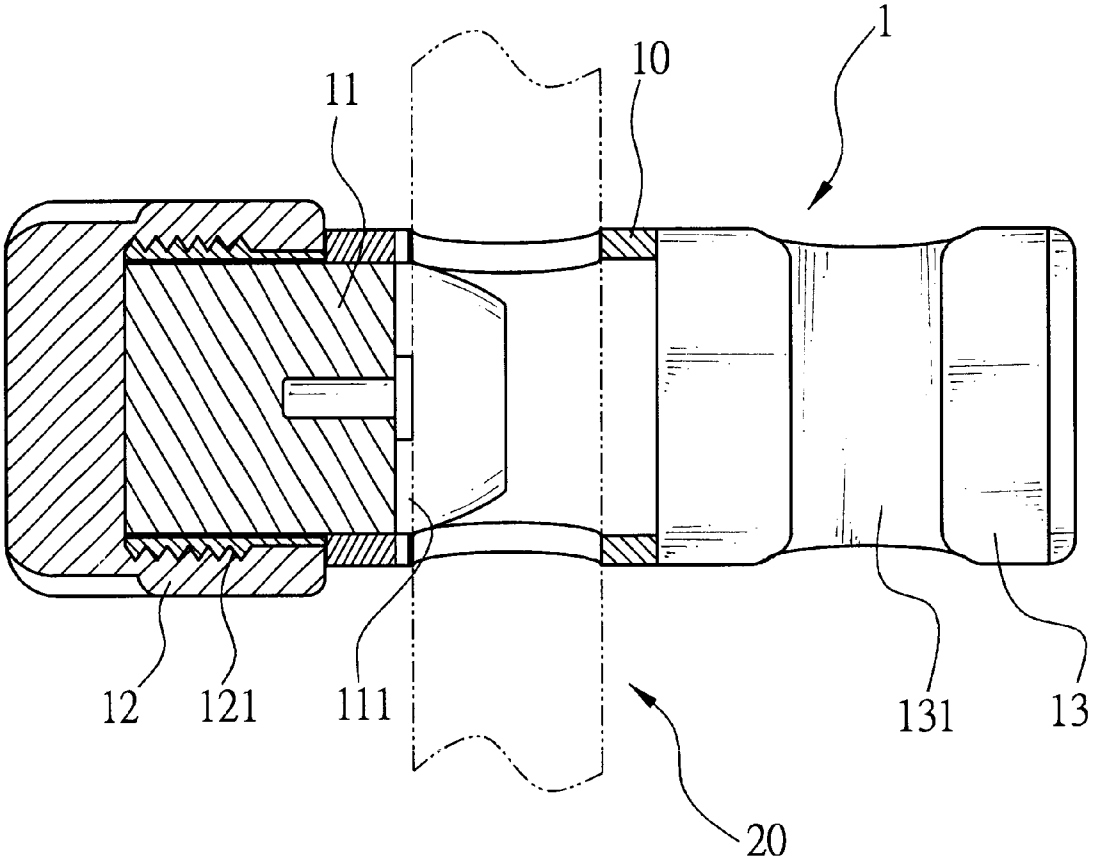
FIG. 2 is a cross sectional view of the FIG. 1 bracket.

Referring to FIGS. 1 and 2, there is shown a detachable bracket 1 for a shower head in accordance with the invention. Bracket 1 is adjustably secured to a post 20 and comprises a substantially cylindrical body 10. The cylindrical body 10 includes an elongate slot 101 having open and closed ends. The elongate slot 101 includes lateral slots 103, 104 that extend along the peripheral surface of the cylindrical body 10, as shown in FIG. 1. The bottom portion of the lateral slots 103, 104 of the slot 101 on the wall of the body 10 is shaped as an open circle so as to allow post 20 to be received therein after it is passed through the internal end of slot 101. The body 10 further includes an outer threaded section 102 on the open end portion thereof. A substantially cylindrical engagement member 11 is inserted into the slot 101. The engagement member 11 includes at least one concave surface 111 that faces the slot 101 to engage the post so that the post is engaged by the engagement member 11 and the body 10. The engagement member 11 includes a hole 112 having a predetermined depth, and a stud 113 formed of flexible material is received in the hole 112. Hence, portions of concave surface 111 are engaged with the post 20 when the engagement member 11 is received in the slot 101. Further, the enlarged flat head of the stud 113 is releasably secured to the inserted post 20. Thus the engagement position of the post 20 and the body 10 may be adjusted. In this embodiment, the stud 113 is used while it can be appreciated by those skilled in the art that stud 113 may be replaced by other suitable member without departing from the scope and spirit of the invention. The engagement member 11 further comprises a pair of opposite projections 114 on its lateral surface. Each projection 114 also has a concave surface on one side thereof facing the slot 101. Hence, two substantially complete circles matching the post 20 are formed on the surface of body 10 when the engagement member 11 is inserted in slot the 101. These substantially complete circles also enhance the securement of the body 10 to the post 20. It is appreciated by those skilled in the art that the projection may be replaced by another suitable member without departing from the scope and spirit of the invention.

A threaded member 12 is provided around the open end portion of the threaded section 102 of body 10. The threaded member 12 comprises an inner threaded section 121 adapted to be threadedly secured to the outer threaded section 102 when the threaded member 12 is put on the internal end of the body 10. It is appreciated by those skilled in the art that the threaded sections may be replaced by other suitable members without departing from the scope and spirit of the invention. In the embodiment, the threaded member 12 is a nut. A substantially cylindrical pivot member 13 is provided at the outer end of body 10. The pivot member 13 has a longitudinal groove 131 perpendicular to the slot 101. Hence, a portable shower head 30 may be hanged on the groove 131.

Figure 3:
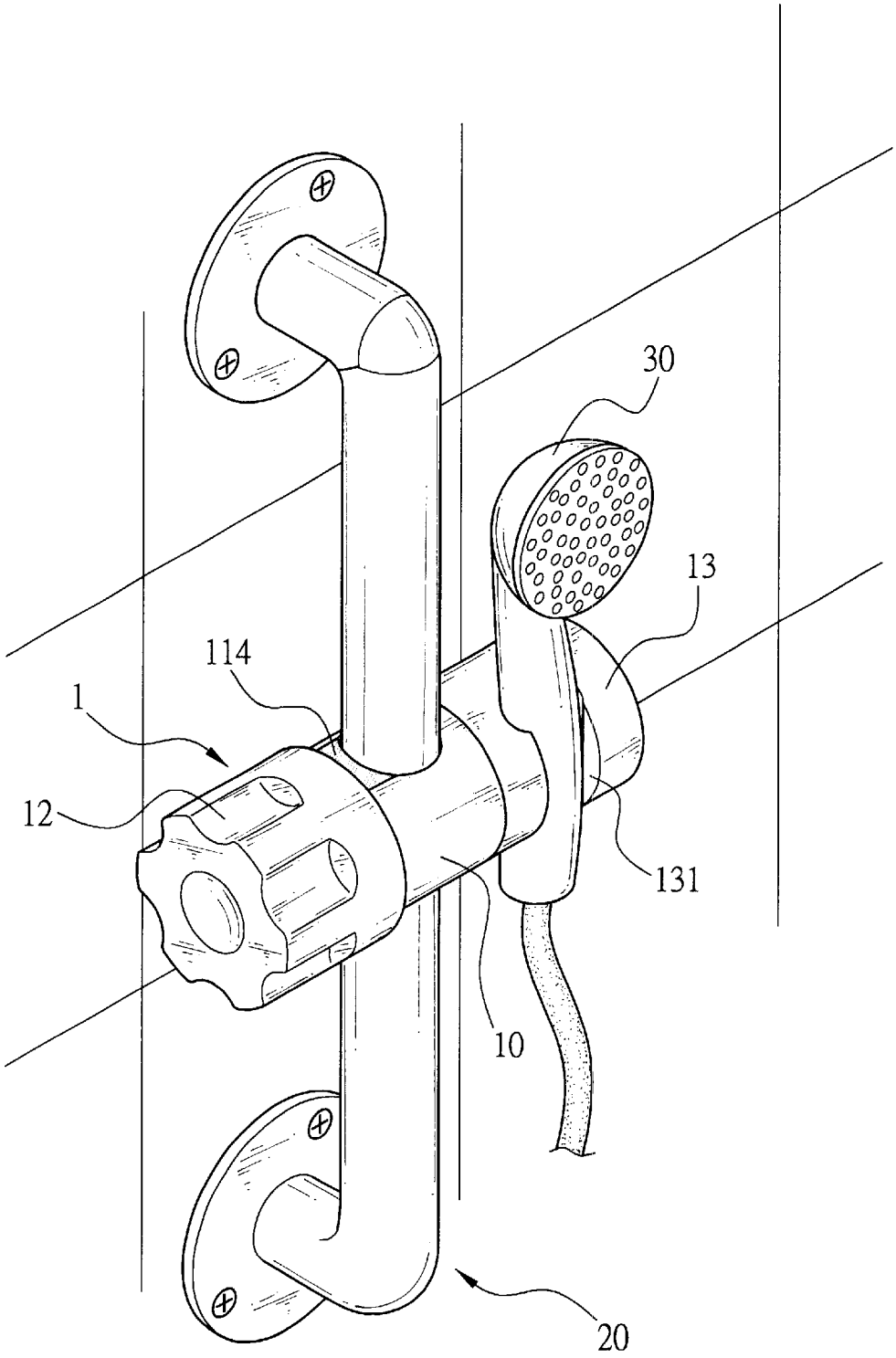
FIG. 3 is a respective view showing the FIG. 1 bracket with a supported shower head where bracket is secured to a post which is mounted on wall of bathroom.

Referring to FIG. 3, a detail assembly and operation of the bracket for shower head will now be described. First mount post 20 to body 10 from the internal end of slot 101. Then slide body 10 along post 20 until a desired height is reached. Next insert engagement member 11 into slot 101 until both portions of concave surface 111 and the enlarged flat head of stud 113 are engaged with post 20. Then threadedly secure threaded member 12 to outer threaded section 102. Finally suitably hang shower head 30 on groove 131. Thus user may enjoy a happy shower thereafter.

The advantages of the detachable bracket for shower head according to the invention are that the drawback of prior art, which requires user to adjust the shower head manually or take another position in order to obtain a better showering angle due to the nonadjustable height of bracket, is eliminated. Thus, the invention can enable people to enjoy bathing. Moreover, the invention can eliminate the disadvantage of prior art which requires user to detach bracket from the wall and replace with a new set of bracket and post once bracket and/or post is malfunctioned. Thus, the invention can save cost, protect wall of bathroom, and effect an environmental design.

While the invention has been described by means of specific embodiments, numerous modifications and variations could be made thereto by those skilled in the art without departing from the scope and spirit of the invention set forth in the claims.

What is claimed is:

1. A detachable bracket comprising:

a body comprising an open elongate slot having an open end portion, the open end portion of the body having an outer thread section;

an engagement member inserted into said slot, said engagement member having a concave surface facing said slot, such that a cylindrical post can be engaged by the concave surface of the engagement member and the body;

a threaded member releasably secured onto the outer-thread section of the open end portion of the body; and a pivot member at an outer end of said body, said pivot member having a longitudinal groove perpendicular to said slot and adapted to receive a shower head.

2. The bracket of claim 1, wherein said body has a substantially cylindrical shape.

3. The bracket of claim 2, wherein said threaded member comprises an inner threaded section being threadedly secured to said outer threaded section when said threaded member is put on said body.

4. The bracket of claim 3, wherein said threaded member is a nut.

5. The bracket of claim 1, further comprising a hole in said engagement member and a stud received in said hole so that said stud is operable to engage with a post.

6. The bracket of claim 5, wherein said engagement member further comprises a pair of opposite projections on a lateral surface thereof, each of said projections having a concave surface on one side thereof facing said slot.

7. The bracket of claim 6, wherein said engagement member has a substantially cylindrical shape.

* * * * *